United States Patent [19]

Matula et al.

[11] 4,358,369

[45] Nov. 9, 1982

[54] HYDROCYCLONE

[75] Inventors: Jouni Matula; Pentti Vikiö, both of Savonlinna, Finland

[73] Assignee: Enso-Gutzeit Osakeyhtiö , Helsinki, Finland

[21] Appl. No.: 269,256

[22] Filed: Jun. 1, 1981

[30] Foreign Application Priority Data

Jun. 2, 1980 [FI] Finland ..... 801767

[51] Int. Cl.[3] ..... B04C 5/085

[52] U.S. Cl. ..... 209/211; 210/512.1; 55/435

[58] Field of Search ..... 209/211, 144; 210/512.1, 85, 94; 55/435, 394; 138/36

[56] References Cited

U.S. PATENT DOCUMENTS

| | | | |
|---|---|---|---|
| 1,938,475 | 12/1933 | Alexander | 138/36 X |
| 1,975,832 | 10/1934 | De Florez | 138/36 |
| 1,977,177 | 10/1934 | De Florez | 138/36 |
| 4,211,643 | 7/1980 | Frykhult et al. | 209/211 |
| 4,278,534 | 7/1981 | Jakobson | 210/512.1 |

FOREIGN PATENT DOCUMENTS

| | | | |
|---|---|---|---|
| 1152950 | 8/1963 | Fed. Rep. of Germany | 138/36 |
| 54-119172 | 9/1979 | Japan | 209/211 |

*Primary Examiner*—Ralph J. Hill

*Attorney, Agent, or Firm*—Toren, McGeady & Stanger

[57] ABSTRACT

Hydrocyclone for dividing a substance mix into an acceptable fraction and a reject fraction containing dirt substances, the hydrocyclone including a separating chamber, which in part consists of a cylinder part, provided with at least one tangential feed connector for the substance mix and with a coaxial exit tube for the acceptable fraction, and which in part consists of a sorter cone on the extension of the cylinder part, having at its apex an exit aperture for the reject fraction. The shell or outer wall surface of the sorter cone has been provided with at least one recessed line or area extending over part or all of its length, whereby as the wall thickness of the sorter cone is substantially reduced from its original amount due to the wear caused by the reject fraction a perforation ensues in the recessed line or area, the leakage taking place therethrough being recovered in a closed chamber located outside the hydrocyclone and which has been formed by affixing to the margins of the recessed line or area a fluted strip with closed ends.

8 Claims, 6 Drawing Figures

HYDROCYCLONE

Figure 1:
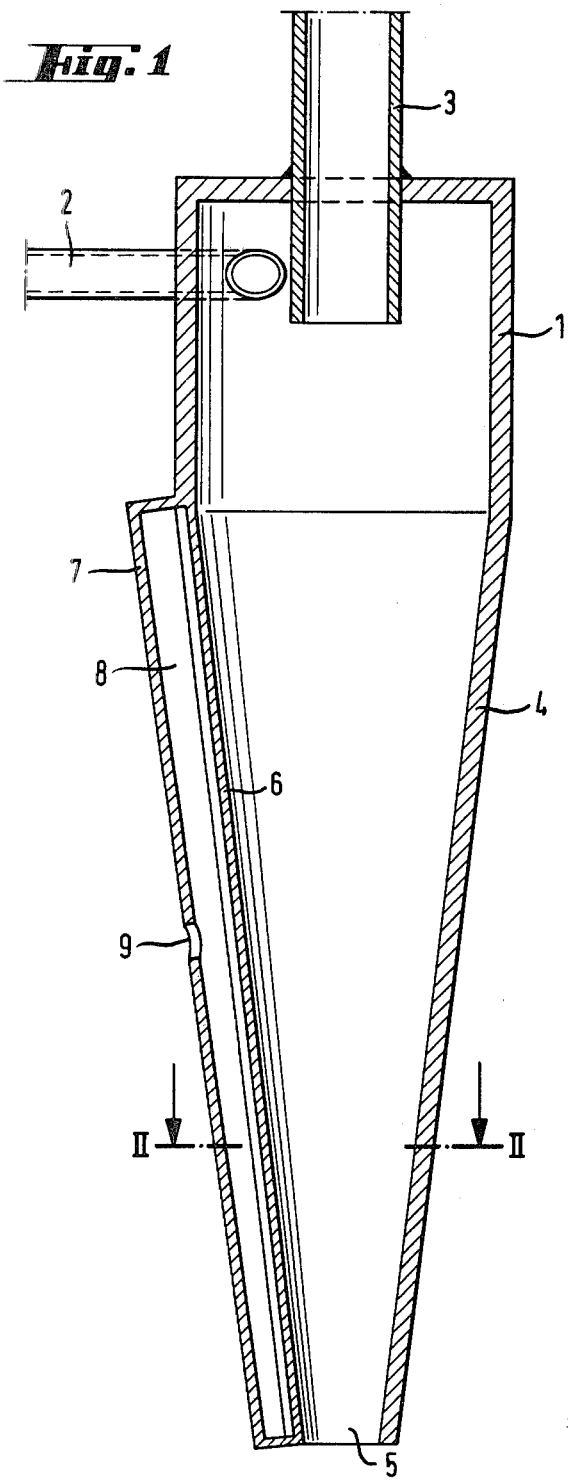

The present invention concerns a hydrocyclone for dividing a substance mix into an acceptable fraction and a reject fraction containing dirt substances, said hydrocyclone comprising a separating chamber consisting in part of a cylindrical part provided with at least one tangential feed connector for the substance mix and with a coaxial exit tube for the acceptable fraction, and in part consisting of a sorter cone on the extension of the cylinder part, having at its apex an exit aperture for the reject fraction.

Hydrocyclones are commonly used in cellulose and paper mills for the purpose of purifying fibre suspensions from dirt substances such as sand, bark and branch pieces, metal particles. The fibre suspension to be purified is supplied under pressure into the hydrocyclone, in the converging sorter cone of which it is forced into a fast rotary motion causing a centrifugal force by the effect of which the component substances of the fibre suspension having different specific gravities become separated. As the fibre suspension vortex progresses towards the apex of the sorter cone, the substances having higher specific gravity, such as sand for instance, are flung out on the walls of the sorting cone, and the sand particles move on helical paths following these walls towards the comparatively small diameter exit aperture on the apex of the sorter cone. In the vicinity of the exit aperture, where the sand particles revolve in a nearly circular orbit, that is in a nearly unchanged plane at right angles to the axis, and where the velocity of the rotary motion is high, it has been found that furrows are worn with time in the walls of the sorter cone as a consequence of the friction encountered, particularly so in hydrocyclones made of plastic. In some instances the furrows have become so deep as to cause the narrow end portion of the sorter cone to be cut off completely. The consequence is then that the fibre suspension in the hydrocyclone is discharged into the ambient space. Since for instance a hydrocyclone installation preceding a paper machine may comprise a great number of separate cyclones, all of which must continuously operate perfectly in the purification of the fibre suspension that is conducted to the paper machine, the unexpected breakage of any one hydrocyclone can in the worst case lead to shut-down of the paper machine, entailing production losses. Moreover, the discharge into ambient space of hot fibre suspension stock may be a source of personnel accidents.

It is known in the prior art, in order to eliminate the drawbacks mentioned, to provide the hydrocyclone with an outer jacket encircling the sorter cone. An enclosed space will then remain between the sorter cone and the outer jacket and into which the substance mix in the hydrocyclone may discharge when the sorter cone is worn through. In this interspace an element is provided which reports that a leak has occurred.

In the above-mentioned hydrocyclone, leakage from a severed sorter cone into ambient space can be prevented. If the outer jacket is made of a transparent material, it is furthermore possible to observe visually the condition of wear of the sorter cone, which is understood to be visible in the form of circular furrows on the inside of the cone. Since in each plane perpendicular to the axis of the sorter cone the centrifugal force acting on the impurity particles is constant (peripheral velocity and orbit radius are constant), the depth of the worn furrow is constant over the whole circumferential length and the wear is uniform. This has the consequence, in its turn, that the sorter cone will when it fails be cut off totally at once, and a large quantity of fibre suspension will discharge into the interspace. This has a detrimental effect on the purifying capacity of the hydrocyclone, since the pressure relations among other things change. Furthermore, the hydrocyclone in question will be expensive to manufacture, a second separate jacket being needed around the sorter cone.

Figure 2:
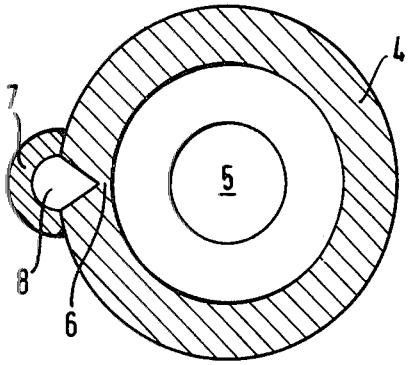

The invention is described in the following in detail by means of a drawing, wherein FIG. 1 presents the longitudinal section of a hydrocyclone acording to an embodiment of the invention, FIG. 2 shows the cross section viewed in the direction of the line II—II in FIG. 1, and in FIGS. 3 through 6 is shown a cross section, like that of FIG. 2, of other embodiments of the invention.

As shown in FIG. 1, the separating chamber of the hydrocyclone consists in part of a cylindrical part 1, which has been provided with a tangential feed connector 2, by which the substance mix to be purified is introduced under pressure into the hydrocyclone. Into the cylinder part 1 extends an exit tube 3, coaxially affixed to the cover of the cylinder part, for the acceptable fraction separating from the substance mix.

The second part of the separating chamber consists of a sorter cone 4 on the extension of the cylinder part 2, and which has at its apex an exit aperture 5 for the reject fraction that has been separated from the substance mix during the vortex motion.

As shown in FIG. 1, the outer shell of the sorter cone 4 presents a recessed line or reduced thickness area 6 extending over its whole length and to the margins of which has been affixed a fluted strip 7 with closed ends, thereby forming over the recessed line 6 an enclosed chamber 8. The reduced thickness area 6 parallels a generatrix line on the outer shell or surface of the sorter cone 4. The reduced thickness area extends at least in some embodiments in the circumferential direction of the outer wall surface of the sorter cone as well as in the axial direction of the cone.

Figure 3:
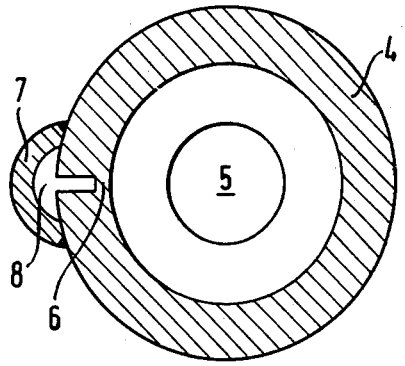
Figure 4:
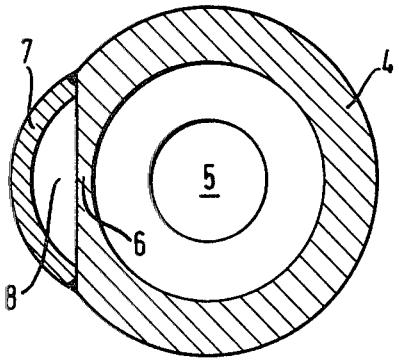
Figure 5:
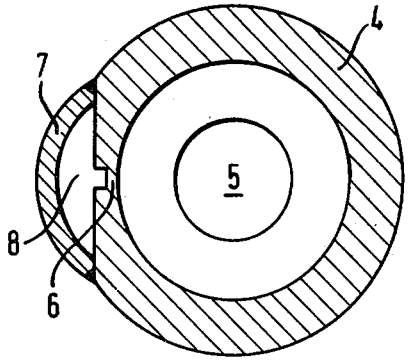
Figure 6:
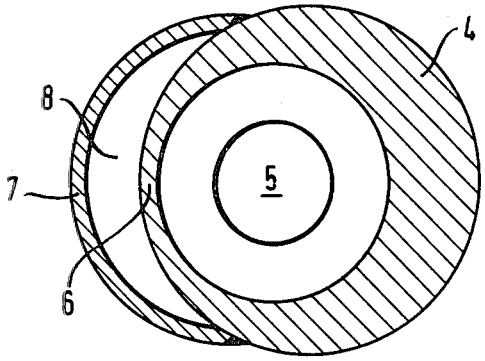

As shown in FIGS. 2 through 6, the recessed line or area 6 may present the shape of a furrow or of a truncation that is a circumferentially extending reduced thickness region. When the recessed line is a furrow, a V or U furrow as shown in FIG. 2 or 3 will be preferentially contemplated. In the embodiments illustrated by FIGS. 4, 5 and 6, the recessed line is a truncation, or cut-off, which may be equivalent to a segment or a sickle (FIG. 6). As FIG. 5 shows, a recessed line or area appearing as a segmentally shaped truncation transversely of the axial direction of the sorter cone may be furthermore provided with a furrow. It is self-evident that the sickle-shaped recessed line or area of FIG. 6 with the sickle shape extending transversely of the axial direction of the sorter cone may as well be provided with a V or U furrow. Furthermore, the furrow may have the shape of a helix circling with gentle pitch around the sorter cone 4; the main thing is that it extends over the whole length of the sorter cone.

The wall thickness of the sorter cone 4 at the recessed line 6 is preferably 0.6 to 0.4 times the normal thickness of the wall.

If the fluted strip 7 consists of transparent material, the progressive wear of the sorter cone 4 at the site of the recessed line 6 may be visually monitored; in the event of perforation ensuing somewhere on the recessed line there will then be a slight leakage from it into the chamber 8.

It is also possible to make an aperture 9 in the fluted strip 7, in which case the fluted strip 7 need not be made of transparent material, since independent of the point at which the recessed line 6 develops a perforation, the chamber 8 will comparatively soon fill with suspension and leakage can now take place through the aperture 9 into ambient space. When such leakage appears, the aperture 9 may be closed, for instance with a screw plug, whereby the pressure conditions within the cyclone are restored and no disturbance occurs in the purifying capacity of the cyclone.

It is possible with a view to automatic monitoring of the leakage, to mount in the aperture 9 a pressure transmitter, or a means measuring electrical conductivity, a pulse supplied by this apparatus reporting the event of leakage.

The invention is not confined to the embodiments of the above disclosure and of the figures, and it may be modified within the scope of the claims following below.

We claim:

1. Improvement in a hydrocyclone for dividing a substance mix into an acceptable fraction and a reject fraction containing dirt substances, said hydrocyclone comprising a separating chamber, including an axially extending part, at least one tangential feed connector for the substance mix opening into said cylinder part and an exit tube coaxial with and opening from said cylinder part for discharging the acceptable fraction, and a sorter cone extending axially from the cylinder part, said sorter cone having at its apex spaced from said cylinder part an exit aperture for the reject fraction, wherein the improvement comprises that the wall of the sorter cone has a reduced thickness area extending for at least a part of the axial length thereof, a strip secured to the outside surface of said sorter cone wall and bridging over and spaced outwardly from said reduced thickness area and forming in combination with said sorter cone wall a closed chamber, whereby as the wall thickness of the sorter cone is substantially reduced from its original amount due to the wear caused by the reject fraction a perforation ensues in the reduced thickness area, the leakage taking place therethrough being recovered in said closed chamber located outside the sorter cone of the hydrocyclone.

2. Hydrocyclone according to claim 1, wherein the reduced thickness area comprises a furrow parallelling a generatrix line of the sorter cone's outer shell.

3. Hydrocyclone according to claim 1, wherein the reduced thickness area comprises a circumferentially extending region of the outer wall surface of the sorter cone with said region extending in the axial direction of the sorter cone along generatrix lines thereof.

4. Hydrocyclone according to claim 3, wherein the circumferentially extending region is segmentally shaped.

5. Hydrocyclone according to claim 4, wherein the circumferentially extending region includes a furrow.

6. Hydrocyclone according to claim 3, wherein the circumferentially extending region has a sickle-shaped cross section transversely of the axial direction of the sorter cone.

7. Hydrocyclone according to claim 6, wherein the circumferentially extending region includes a furrow.

8. Hydrocyclone according to claim 2, 5 or 7, wherein the furrow is one of a V and U shaped furrow.

* * * * *